US006074536A

United States Patent [19]

Van den Bergan

[11] Patent Number: 6,074,536

[45] Date of Patent: Jun. 13, 2000

[54] ELECTROYLTIC CELL AND METHOD FOR REMOVING SILVER FROM SILVER-CONTAINING AQUEOUS LIQUIDS

[75] Inventor: Patrick Van den Bergan, Hove, Belgium

[73] Assignee: Agfa-Gevaert N.V., Mortsel, Belgium

[21] Appl. No.: 09/015,445

[22] Filed: Jan. 29, 1998

[30] Foreign Application Priority Data

Jan. 31, 1997 [EP] European Pat. Off. ..... 97200266

[51] Int. Cl.[7] ..... C25C 7/00

[52] U.S. Cl. ..... 204/229.1; 204/272; 204/275

[58] Field of Search ..... 205/263, 571, 205/701, 771; 204/272, 275, 229.1

[56] References Cited

U.S. PATENT DOCUMENTS 3,901,777 8/1975 Bentley ..... 205/571
3,936,363 2/1976 Fesseden .
4,036,715 7/1977 Baden et al. ..... 205/571
4,439,300 3/1984 Houseman .
5,399,249 3/1995 Scheufler ..... 204/272
5,454,924 10/1995 Jansen et al. .

FOREIGN PATENT DOCUMENTS 8600094 1/1986 WIPO .

*Primary Examiner*—Arun S. Phasge
*Attorney, Agent, or Firm*—Baker & Botts, L.L.P.

[57] ABSTRACT

The cell comprises a housing (10) including a base (15), an anode (20) positioned within the housing (10), a cathode (30) surrounding the anode (20) in the housing (10), an inlet opening (18), and an outlet opening (19). The outlet opening (19) through the base (15) leads to an outlet passage (21) through the anode (20). The cell is operated under negative pressure. This construction enables a simple manufacturing of the cathode, without the need for holes therein. The liquid may be easily de-aerated leading to more uniform deposition of silver on the cathode.

1 Claim, 2 Drawing Sheets

ELECTROYLTIC CELL AND METHOD FOR REMOVING SILVER FROM SILVER-CONTAINING AQUEOUS LIQUIDS

FIELD OF THE INVENTION

This invention relates to an apparatus for the electrolytic recovery of silver from solutions containing silver, in particular used photographic solutions such as fixing and bleach-fixing solutions.

BACKGROUND OF INVENTION

Electrolytic silver recovery from used photographic solutions is a common way to extend the life of such solutions.

An apparatus for the electrolytic recovery of silver from solutions containing silver is known from United States patent U.S. Pat. No. 5,378,340 (Michiels et al. assigned to Agfa-Gevaert NV) issued 3 Jan. 1995. The apparatus comprises an electrolytic cell including: a housing; an anode having an exposed anode portion within the housing; and a cathode having an exposed cathode portion located within the housing and encircling the anode. In use silver from the silver containing solution is deposited on the face of the cathode which is directed towards the anode. After the cell is operated for some time, the cathode is removed from the cell and replaced.

In a known method of removing silver from silver-containing aqueous liquids, the liquid to be treated is pumped into the electrolytic cell and electrical power is fed to the anode and the cathode to cause silver to be deposited on the cathode. The cathode is usually removable, and after a certain amount of silver has built up thereon, the cathode is removed and replaced. In the cell described in U.S. Pat. No. 5,378,340, the electrical connection to the cathode is below the liquid level in the cell, so that deposits may form on this connection. This leads to unpredictability in the electrical energy fed to the cell, making control of the process difficult. Furthermore, a reference electrode is placed in a side arm of the housing and in order for this electrode to accurately reflect the condition of the bulk of the liquid in the cell, it was necessary to form the cathode with holes there-through. Such holes also contribute to good circulation of the electrolyte through the cell. Not only does the formation of these holes constitute an additional manufacturing step, the holes result in uneven deposition of silver on the cathode. Also, the presence of gas bubbles in the liquid, which bubbles may be seeded for example at the surface of the cathode, may cause non-uniform deposition of silver to occur.

We are aware of United States patent U.S. Pat. No. 4,439,300 (Kenneth R Houseman/General Dental Inc.) which describes a device for collecting silver from photographic solutions in which a vortex is generated to promote increased electrolytic action. The device includes an anode in the form of a cylindrical tube, the upper end of which leads to an outlet passage in an upper part of the device. The disclosure in this patent fails to address the problem of de-aerating the device. Furthermore, the device described in U.S. Pat. No. 4,439,300 cannot be filled with liquid from empty in a simple and convenient manner.

We are also aware of French patent application FR 2270345 (Eastman Kodak Company) which describes a process for the recovery of silver in an electrolytic cell in which the solution is circulated by reduced pressure. The disclosure in this patent application fails to address the problem de-aerating the cell.

OBJECTS OF INVENTION

It is an object of the present invention to overcome the aforesaid disadvantages.

SUMMARY OF THE INVENTION

We have discovered that this objective and other useful advantages may be achieved when the outlet opening leads to an outlet passage through the anode and the cell is operated under negative pressure.

Thus, according to a first aspect of the invention, there is provided an electrolytic cell for removing silver from silver-containing aqueous liquids, comprising a housing including a base, an anode positioned within the housing, a cathode surrounding the anode in the housing, an inlet opening, and an outlet opening through the base, characterised in that the outlet opening leads to an outlet passage through the anode.

In a preferred embodiment, the anode comprises a tube extending from the base. The tube may surround and be concentric with the outlet passage. The hollow interior of the tube may constitute a circulation passage, of annular cross-section, which surrounds the outlet passage.

A pump, such as a volumetric pump, may be connected to the outlet opening of the cell enabling the cell to be filled, de-aerated and operated under negative pressure. Where the cell is hermetically sealed, operation of the volumetric pump can be used to fill the cell with liquid through the inlet opening, by creating a negative pressure in the cell. The use of this arrangement enables the cell to work under negative pressure and also ensures that the liquid in the cell is de-aerated. This leads to more uniform deposition of silver at the cathode.

The outlet passage may open from the interior of the cell at a level above the level at which the circulation passage opens into the cell, thereby to define a liquid level in the cell. The cathode is preferably removable from the cell and comprises an electrical connection which may be positioned above the liquid level. In order to enable the cathode to be removed, a removable lid may be provided which, when secured to the housing, serves to hermetically seal the cell. Alternatively, the lid may be integral with the cathode. The inlet opening preferably opens into the cell between the anode and the cathode.

Preferably, the lower edge of the cathode is positioned above the base of the housing to leave a space therebetween defining a sump.

A further pump may be provided to circulate liquid through the cell. This circulation pump may be connected between the circulation passage and the interior of the housing to circulate liquid being treated through the cell. It is particularly beneficial if this circulation pump injects recirculating liquid tangentially into the sump of the housing, since this arrangement results in efficient mixing of the liquid.

According to a second aspect of the invention, there is provided a method of removing silver from silver-containing aqueous liquids in an hermetically sealed electrolytic cell comprising a closed housing, an anode positioned within the housing, and a cathode surrounding the anode in the housing, characterised in that the cell is filled, de-aerated and operated under negative pressure.

The method preferably includes filling the cell with liquid to be treated therein, through the inlet opening which opens into the cell between the anode and the cathode, by the application of negative pressure to the outlet passage which extends through the anode, and de-aerating the cell by circulating the liquid within the cell to generate a vortex above the outlet passage while continuing the application of negative pressure to the outlet passage.

It is desirable to stop the circulation pump when too much air passes through the outlet opening. To achieve this, an optical sensor, capable of distinguishing between fluid and air in the outlet opening, may be positioned between the cell and the volumetric pump, but above the latter. In this way de-aeration of the cell can be achieved very quickly. Due to the action of the centrifugal pump a vortex is formed above the outlet opening. The air in the vortex is sucked in by the volumetric pump. When too much air is sensed in the outlet opening, the circulation pump is caused to stop, while the volumetric pump continues to operate. When the circulation pump stops, the vortex remains for about one second, allowing even more air to leave the cell. Once the optical sensor detects fluid, the centrifugal pump starts again, but with less air in the cell. After a few such de-aeration cycles, only a small air bubble is left. This bubble is too small to create a vortex and does not therefore enter the pumps.

For optimum performance of the cell, it is important that the potential between the cathode and the reference electrode is accurately controlled. Usually the electrolytic cell further comprises a reference electrode for this purpose. The reference electrode may be positioned in a side arm of the housing, projecting into the sump. Where, for example, an Ag/AgCl reference electrode is used, the potential between the cathode and the reference electrode is about 400 mV. When the unit is to perform optimally, meaning employing the maximum current without causing side reactions to occur, the potential should be measured with an accuracy of some millivolts. The reference electrode may be a calomel type electrode or an Ag/AgCl type electrode. A suitable electrode has been disclosed in application EP 0 598 144 (Agfa Gevaert NV) filed 11 Nov. 1992 entitled "pH Sensitive Reference Electrode in Electrolytic Desilvering".

In a preferred embodiment of the invention, the top of the exposed anode portion lies below the top of the exposed cathode portion.

This is easily achieved where the anode is supported within the housing from the base thereof. Thus, the housing is preferably formed of electrically non-conductive material, and comprises a base wall and side walls, the anode being supported by the base wall and the cathode being positioned adjacent the side walls.

The housing may be of any suitable shape, but it is preferred to be generally cylindrical, the anode being in the form of a tube positioned axially within the housing. In any case, the anode is encircled by the cathode.

The cathode is preferably in sheet form and ideally has a frusto-conical cross-section, with its larger radius end uppermost, that is towards the circular upper opening of the electrolyte cell. This configuration enables easy removal of the cathode even after a silver deposit has built up there-on after use. Usable cathode materials include stainless steel, silver and silver alloys, and other conductive materials, the non-silver containing materials being preferred from the point of view of costs, while the silver containing materials cause fewer starting-up problems. A cylindrical shape to the housing enables the cathode to be positioned near to the wall of the cell. By arranging for the lower edge of the cathode to be spaced from the base of the housing, it is possible for the reference electrode to be located in a side arm of the housing, the side arm opening into the housing below the level of the cathode.

The material used for the anode is less critical, although platinated titanium is usually used.

The "solutions containing silver" which can be desilvered using the apparatus according to the present invention include any solution containing silver complexing agents, e.g. thiosulphate or thiocyanate, sulphite ions as an anti-oxidant and free and complexed silver as a result of the fixing process. The apparatus can also be used with concentrated or diluted used fixing solutions, or solutions containing carried-over developer or rinsing water. Apart from the essential ingredients, such solutions will often also contain wetting agents, buffering agents, sequestering agents and pH adjusting agents.

The apparatus of the present invention can also be used for desilvering bleach-fixing solutions which may additionally contain bleaching agents such as complexes of iron(III) and polyaminocarboxylic acids.

The desilvering process can be carried out batch-wise or continuously, the apparatus being connected to the fixing solution forming part of a continuous processing sequence.

DETAILED DESCRIPTION OF THE INVENTION

BRIEF DESCRIPTION OF THE DRAWINGS

The invention will be described by the following illustrative embodiments with reference to the accompanying drawings without the intention to limit the invention thereto, and in which.

Figure 1:
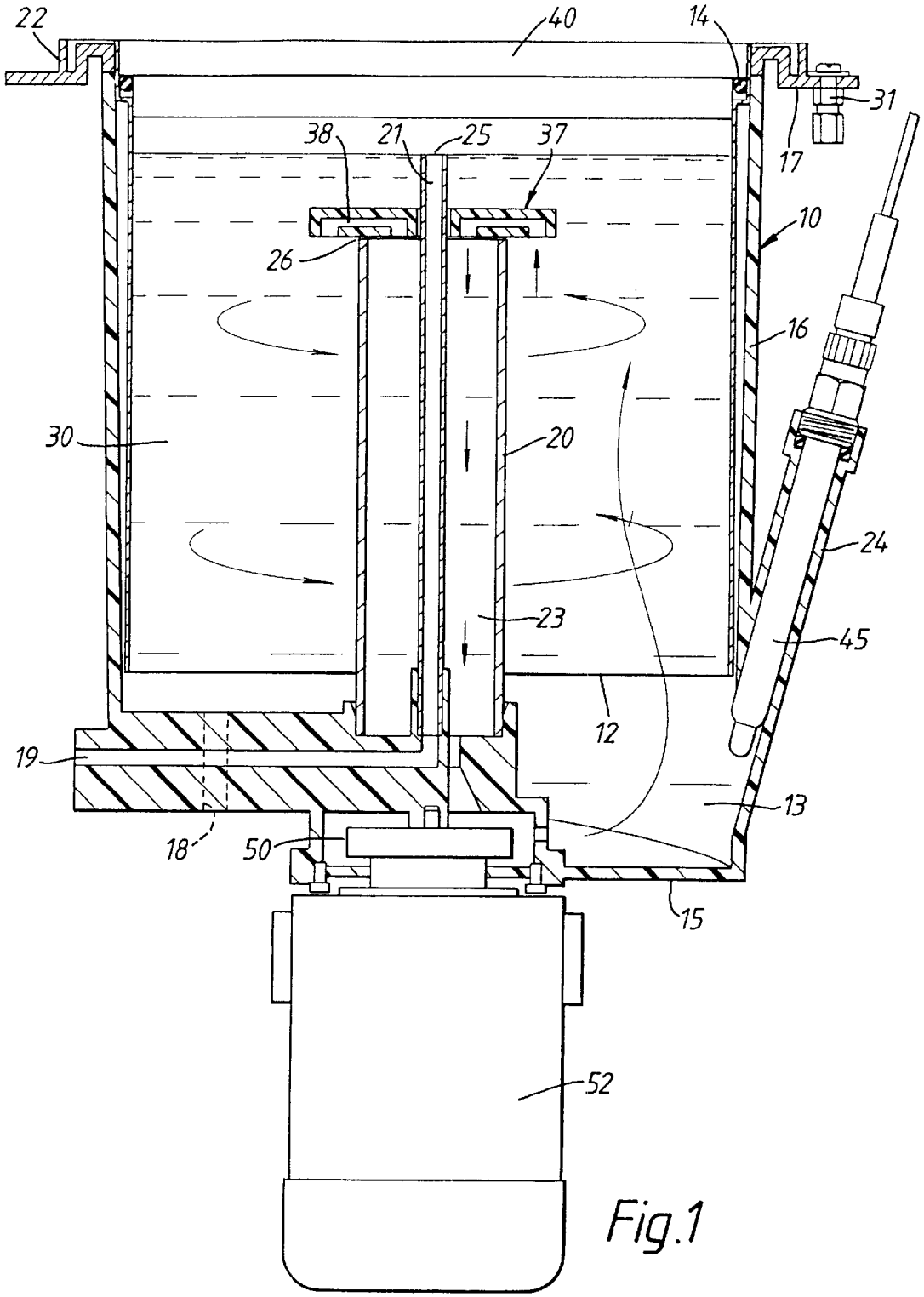
FIG. 1 shows a cross section of an electrolytic cell according to the invention.

As shown in the Figures, the apparatus comprises a generally cylindrical bucket-shaped electrolytic cell housing 10, formed of electrically non-conductive material such as PVC, and comprising a base 15, sides 16 and an upper portion 17. The upper diameter of the housing 10 is marginally larger than the lower diameter by a factor of 1.05. Positioned within the cell are a tubular anode 20 and a cylindrical cathode 30.

A liquid inlet opening 18 leads through the base 15 of the cell and opens into the cell between the anode tube 20 and the cathode 30. An outlet opening 19 extends through the base 15 of the cell and leads to a relatively narrow PVC tube defining an outlet passage 21. An annular circulation passage 23 is thereby defined, which surrounds the outlet passage 21 and is concentric therewith. The outlet passage 21 opens from the interior of the cell at a level 25 above the level 26 at which the circulation passage 23 opens into the cell, thereby to define a liquid level in the cell. An annular PVC cap 37 sits on top of the anode tube 20 and includes a U-shaped cross-section channel 38 opening downwards at one end into the circulation passage 23 and at the other end into the interior of the cell.

The cathode 30, formed for example of stainless steel covered with a thin layer of silver, is located in the cell 10 with its faces spaced from the sides 16. The lower edge 12 of the cathode is spaced above the base of the housing so as to leave a sump 13 from which a side arm 24 of the housing leads.

The anode 20, in the form of a platinised titanium tube, is secured to the base 15 of the cell by means of a contact piece (not shown in detail) integral with the housing of the cell, which contact piece acts as an electrical connector for the anode. The anode tube 20 lies along the axis of the housing 10. A centrifugal circulation pump 50, together with an associated pump motor 52, is connected to the base of the cell and serves to circulate the liquid in the cell by removing liquid from the circulation passage 23 and injecting it tangentially into the sump 13 of the housing 10, as indicated by the arrows in FIG. 1.

The reference electrode 45 is positioned in the side arm 24 of the housing and protrudes into the sump 13 of the cell. A suitable reference electrode is a pH sensitive glass electrode such as a YOKOGAWA SM21/AG2 or an INGOLD HA265-58/120 glass electrode.

The upper part 17 of the cell is in the form of a neck portion having an opening defined by a stainless steel ring 22. The stainless steel ring 22 is permanently fixed to one end of a bolt 31 which extends through the wall of the cell and provides a connector for the cathode 30. Positioned in the neck of the cell, below the level of the annular ring 22, is a sealing ring 14.

The apparatus further comprises a lid 40 so shaped as to fit into the neck portion of the cell. The lid 40 is formed of electrically non-conductive material such as PVC.

The cathode 30, formed for example of stainless steel sheet having a thickness of 100 $\mu$m, is wrapped around into a cylindrical configuration. The cathode 30 is provided with a deformable upper edge portion, formed by the provision of slots (not shown), the sheet material of which the cathode is formed being sufficiently resilient to allow the upper edge portion to bend outwardly in response to outwardly directed force.

As the lid is screwed into place, a contact surface on the lid bears against the upper edge portion of the cathode 30, causing the upper edge portions to bend outwardly against the annular surface of the ring 22. Tightening of the lid causes the upper edge portion to be clamped firmly by the lid against the ring 22, thereby establishing good electrical contact there-between. In the closed position of the lid, the sealing ring 14 bears against the lower edge of the lid 40, thereby forming a tight seal.

Figure 2:
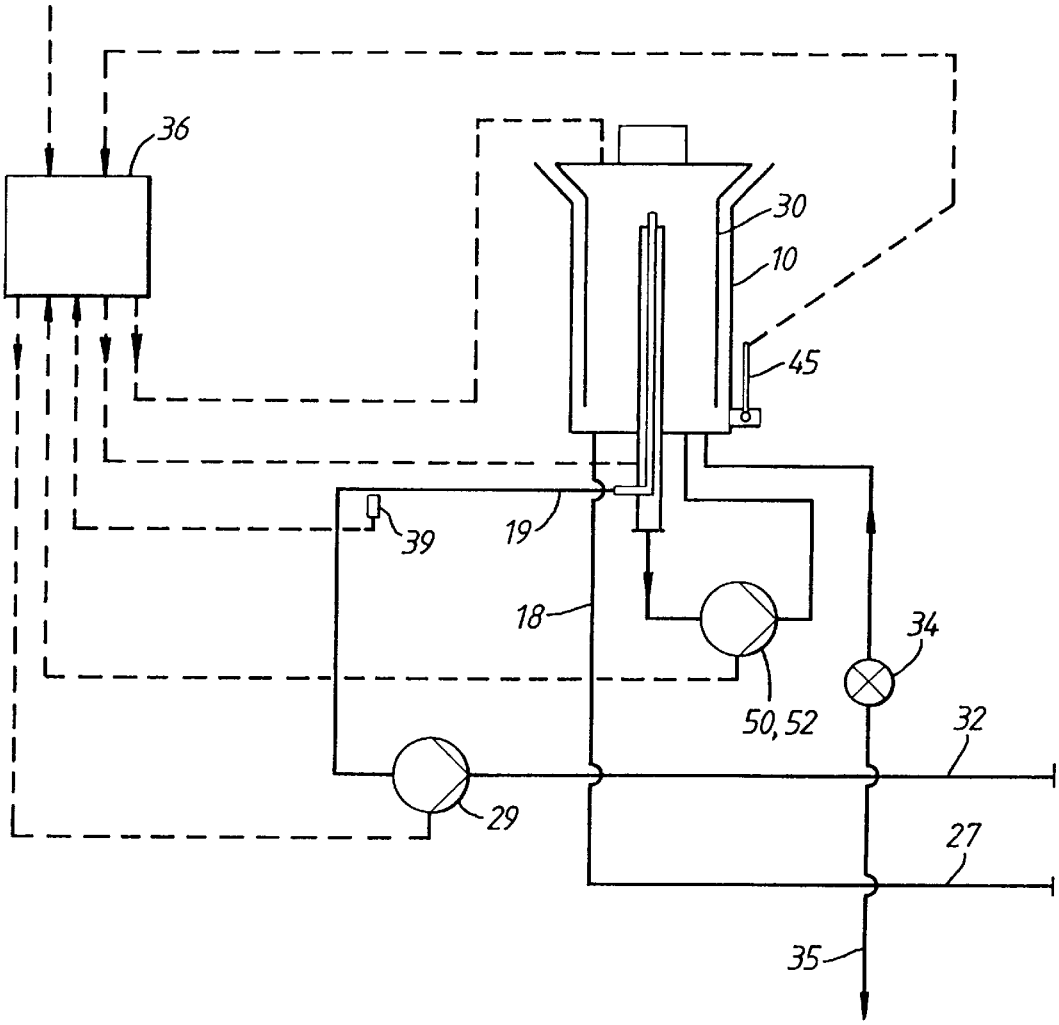
FIG. 2 shows schematically the liquid and electrical connections to the cell.

The liquid and electrical connections to the cell are shown schematically in FIG. 2. Fixer or other silver-containing liquid enters along an inlet line 27 having an internal diameter of say 10 mm.

When the cell is initially empty, but the lid 40 is attached hermetically sealing the cell, operation of a volumetric pump 29 extracts air from the cell and pulls liquid from the inlet line 27 into the cell through the inlet opening 18. Treated liquid from the cell is pumped by the pump 29 along an exit line 32, of say 10 mm diameter at say 1 liter/min. An optical level sensor 39 is provided in a cavity adjacent the exit line 32 at a position above the level of the volumetric pump 29. This sensor stops the circulation pump 50 each time too much air passes through the cavity. The volumetric pump 29 continues to operate however. By this arrangement de-aeration of the cell proceeds quickly. Due to the action of the circulation pump 50 a vortex is formed above the outlet passage 21. The air of the vortex is sucked in by the volumetric pump 29. This air is sensed by the sensor 39 which causes the circulation pump 50 to stop. The vortex remains for about one second, allowing even more air to leave the cell. Once the sensor 39 detects liquid, the circulation pump 50 is caused to re-start. Further pumping not only continues to fill the cell, but also de-aerates the liquid in the cell. After 2 to 4 de-aeration cycles, in a span of less than a minute, only a small air bubble is left above the outlet passage 21. This bubble is too small to create a vortex and no further air enters the outlet passage 21. The liquid is circulated through the cell by the circulation pump 50 at say 20 liters/min.

The cell is then operated under usual conditions, during which a silver deposit builds up on the cathode 30, primarily on the inside surface thereof. Electronic circuitry 36 controls the de-silvering process in a known manner. After a period of time determined by the required amount of deposited silver, the operator unscrews the lid 40 and lifts the cathode 30 out of the cell. Due to the frusto-conical cross-section of the housing 10, the sides of the cathode will not foul against the ring 22, even when some small amount of silver deposit has built up on the outside surface thereof. The silver deposit is then removed from the cathode, which may then be re-used as desired or replaced by another cathode of similar construction for the de-silvering of a further batch of electrolyte. The cell may be drained via a drain valve 34 and drain line 35.

I claim:

1. An electrolytic cell for removing silver from silver-containing aqueous liquids, comprising a housing, a base, an anode positioned within said housing, a cathode surrounding said anode in said housing, an inlet opening, and an outlet opening through said base, characterized in that said outlet opening leads to an outlet passage through said anode, wherein said outlet opening is connected to a pump enabling the cell to be filled, de-aerated and operated under negative pressure, and wherein the lower edge of the cathode is positioned above the base of the housing to leave a space therebetween defining a sump, from which a side arm of the housing extends, a reference electrode being positioned in said side arm and projecting into said sump.

* * * * *